United States Patent [19]

Eckert

[11] Patent Number: 4,735,773

[45] Date of Patent: Apr. 5, 1988

[54] INERTIAL MIXING METHOD FOR MIXING TOGETHER MOLTEN METAL STREAMS

[75] Inventor: Charles E. Eckert, Plum Boro, Pa.

[73] Assignee: Aluminum Company of America, Pittsburgh, Pa.

[21] Appl. No.: 939,147

[22] Filed: Dec. 8, 1986

[51] Int. Cl.[4] ..... C22C 21/00

[52] U.S. Cl. ..... 420/528; 75/63; 75/65 R; 75/93 R; 420/590

[58] Field of Search ..... 75/63, 65 R, 68 R, 93 R; 420/590, 528

[56] References Cited

U.S. PATENT DOCUMENTS

| | | | |
|---|---|---|---|
| 2,100,264 | 11/1937 | Perrin | 75/24 |
| 2,572,489 | 10/1951 | Jordan | 75/93 R |
| 4,191,563 | 3/1980 | Smartt | 75/53 |
| 4,556,535 | 12/1985 | Bowman et al. | 420/580 |

*Primary Examiner*—Peter D. Rosenberg

*Attorney, Agent, or Firm*—Andrew Alexander; John P. Taylor

[57] ABSTRACT

A system is disclosed for efficiently mixing streams of molten metal to form a molten metal alloy while inhibiting oxidation and introduction of impurities such as hydrogen gas into the molten metal which comprises passing a first molten metal stream at a minimum velocity of at least 18 cm/sec into a mixing zone and feeding a second molten metal stream at a lower velocity into the mixing zone through a concentric feed tube around which the first molten metal stream is flowing. The first molten metal stream is maintained in turbulent flow conditions with a Reynolds number of greater than 2100. In a preferred embodiment, the minimum velocity of the first stream is raised before reaching the mixing zone by introducing a non-oxidizing gas into the stream.

19 Claims, 4 Drawing Sheets

INERTIAL MIXER

INERTIAL MIXING METHOD FOR MIXING TOGETHER MOLTEN METAL STREAMS

BACKGROUND OF THE INVENTION

1. Field of the Invention

This invention relates to molten metal mixing. More particularly, the invention relates to the mixing together of several streams of molten metal by transfer of momentum to form a molten metal alloy.

2. Description of the Related Art

The production of aluminum base alloys has become of increasing interest due to the combination of lightweight and high strength which such an alloy can be made to possess. However, the formation of some aluminum base alloys is significantly more difficult than that of other aluminum base alloys due to the rapid adsorption of hydrogen gas by some alloys such as, for example, aluminum-lithium alloys; reaction of some alloys with refractory linings in the furnace; and composition gradients in the cast ingot due to the propensity of some alloying metals such as, for example, lithium to oxidize during processing of the molten alloy after the addition of the alloying metal.

Attempts have been made to remedy these problems by, for example, adding the lithium to the melt after degassing of the molten aluminum. The lithium is introduced into the molten aluminum from an entrance port submerged beneath the surface of the molten aluminum to ensure faster melting and mixing with minimum oxidation of the lithium. Such an apparatus is shown in Bowman et al U.S. Pat. No. 4,556,535, assigned to the assignee of this invention.

The need for uniformity of composition usually requires mechanical stirring which may promote oxidation as well as further hydrogen absorption. The molten mixture is, therefore, preferably degassed after the mixing step to lower the impurity content of the melt by bubbling a sparging gas through the molten metal.

It would, however, be desirable to perform the mixing of the molten metal streams together in a manner which would minimize either oxidation or the introduction of impurities such as hydrogen into the mixture while efficiently mixing the molten metal streams together.

SUMMARY OF THE INVENTION

It is, therefore, an object of the invention to provide an improved system for mixing together streams of molten metal to form a molten metal alloy.

It is another object of the invention to provide an improved system for mixing together streams of molten metal to form a molten metal alloy using transfer of momentum from one stream moving at a velocity of at least about 75 cm/sec to another slower moving stream.

It is yet another object of the invention to provide an improved system for mixing together streams of molten metal to form a molten metal alloy using transfer of momentum from one stream of higher velocity to another stream introduced into the flow concentrically to the first stream and establishing turbulent flow in a mixing zone characterized by a Reynolds number of greater than 2100.

It is a further object of the invention to provide an improved system for mixing together streams of molten metal to form a molten metal alloy using transfer of momentum from one stream of higher velocity to another stream introduced into the flow concentrically to the first stream while maintaining a metal velocity of at least 7.5 cm/sec in the mixing zone.

These and other objects of the invention will be apparent from the following description and accompanying drawings.

In accordance with the invention, a system is provided for efficiently mixing streams of molten metal to form a molten metal alloy while inhibiting oxidation and hydrogen gas adsorption in the molten metal which comprises passing a first molten metal stream at a minimum velocity, e.g., at least 18 cm/sec, into a mixing zone and feeding a second molten metal stream at a lower velocity into the mixing zone through a feed tube into the first molten metal stream. The first molten metal stream may be maintained in turbulent flow conditions with a Reynolds number of greater than 2100.

DETAILED DESCRIPTION OF THE INVENTION

Figure 1:
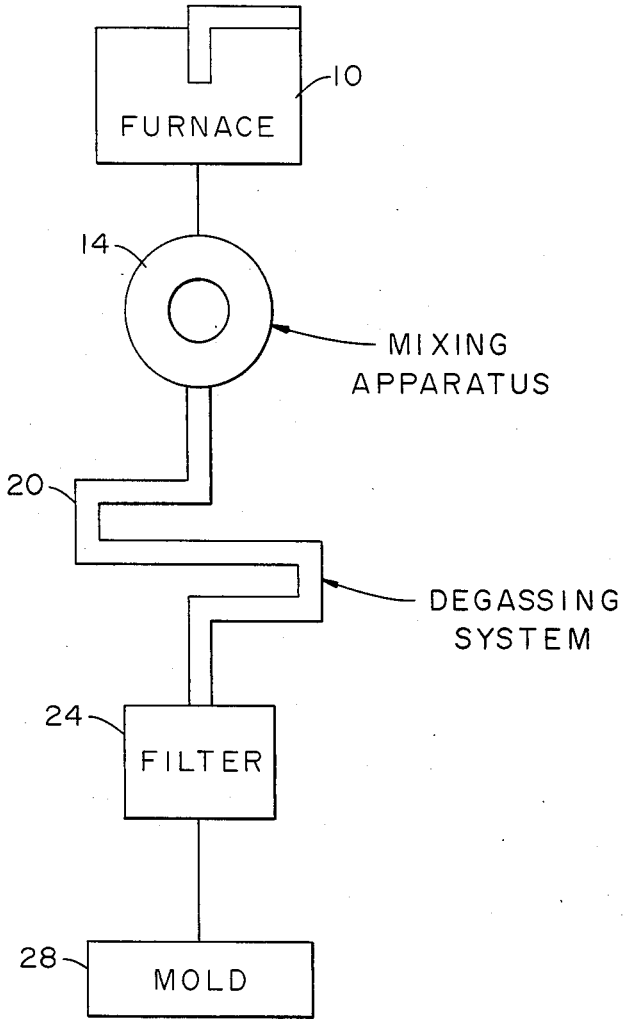
FIG. 1 is a diagramatic flow sheet of a molten metal process showing the molten metal mixing system of the invention.
Figure 2:
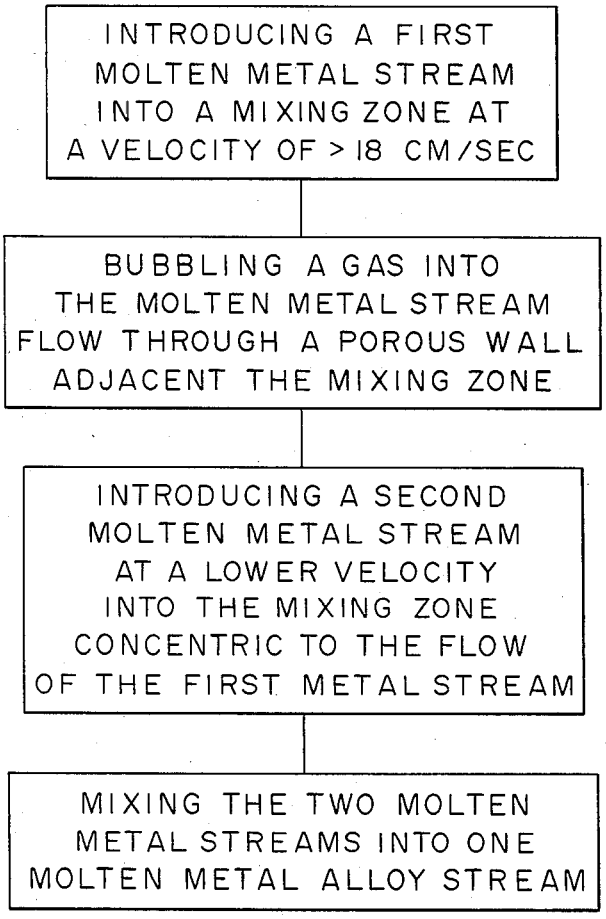
FIG. 2 is a flow sheet illustrating the process of the invention.

Referring to FIG. 1, molten metal, such as, for example, aluminum, is heated in a furnace 10. The molten metal is then transported to mixing apparatus 14 in accordance with the invention where it is mixed with other alloying metals, e.g., lithium, to form the desired molten metal alloy. The molten metal alloy is then passed through the degassing system 20 and then filtered at 24 to remove any solids before introducing the molten alloy mixture into a mold 28.

Figure 3:
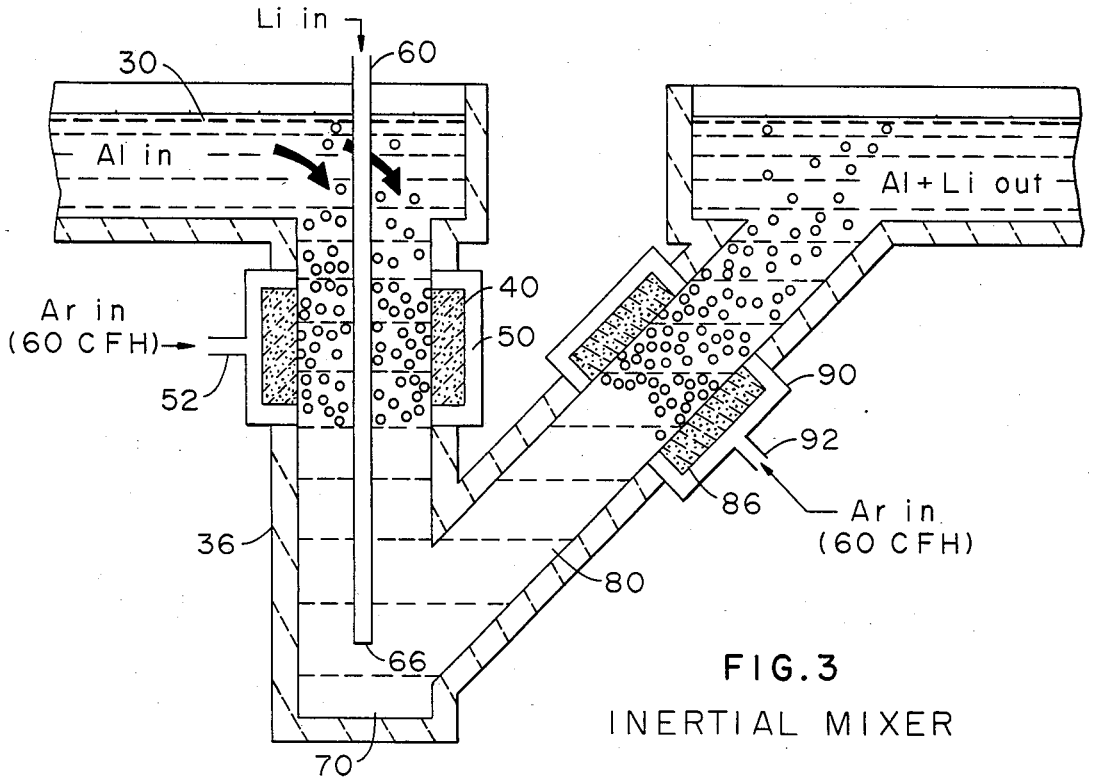
FIG. 3 is a vertical side-section view of apparatus used in the system of the invention.
Figure 4:
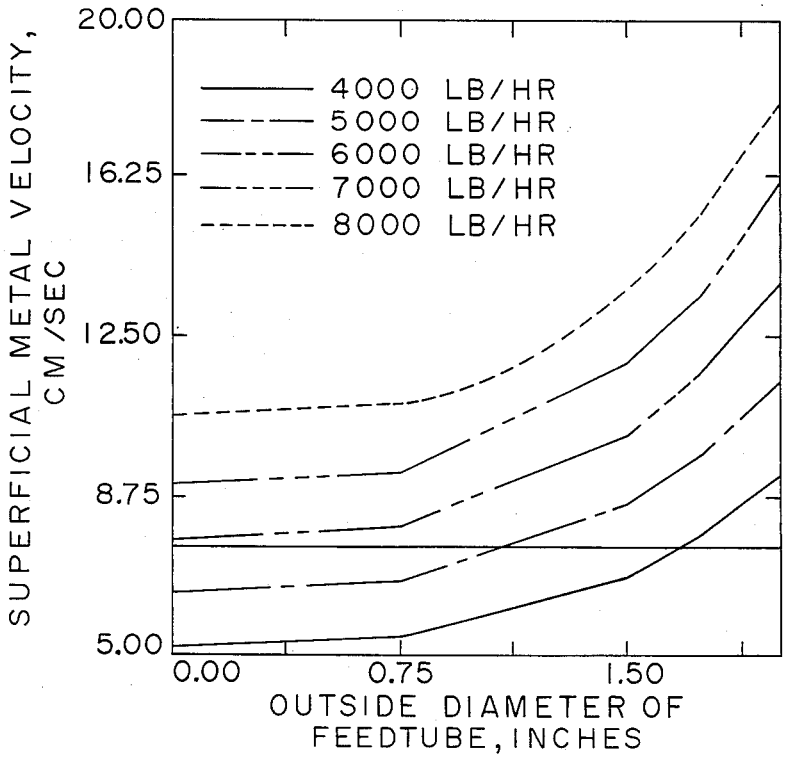
FIG. 4 is a graph showing the relationship between O.D. of the concentric feed tube and metal velocity for various total pounds of metal per hour.

As shown in FIG. 3, mixing apparatus 14 may comprise a reservoir 30 and a large cylinder 36 connected to the bottom of reservoir 30. The inner diameter of cylinder 36 may range from about 2 to 5 inches. Molten metal may flow from reservoir 30 into cylinder 36, for example by gravity, at a velocity of approximately 1.1 cm/sec. In a preferred embodiment wherein molten aluminum is present in reservoir 30, the liquid density of the molten metal flowing into cylinder 36 from reservoir 30 is about 2.4 grams/cm$^3$.

A feed tube 60 is positioned to feed a molten metal stream, e.g., a stream of alloying metal, for example, lithium, into the molten metal flowing through cylinder 36. In the embodiment shown in FIG. 3, the alloying metal flowing through tube 60 exits at 66 into a mixing zone 70 within cylinder 36 where the two molten metal streams combine. It will be appreciated that in certain alloying situations it can be more difficult to introduce the alloying stream to the base metal, particularly where there is a large density difference as in the case of aluminum being alloyed with lithium. In one aspect of the invention, the molten lithium can be effectively alloyed into the molten aluminum by having different flow rates. That is, the flow rate of the molten metal flowing through cylinder 36 should be sufficient to overcome the buoyancy or the tendency of the lithium exiting at 66 to rise before becoming alloyed with molten aluminum. Thus, the two metals are homogeneously mixed before leaving mixing zone 70. Once the lithium is alloyed with the molten aluminum, then separation therefrom is not a problem as the molten metal flows into channel 80. Only a very short time, e.g. not normally more than 15 seconds contact time, at molten metal temperature is required to alloy the lithium with the molten aluminum.

In another aspect of the invention, the lithium can be held in contact with the molten aluminum by temporarily introducing a gas into the molten aluminum as it flows through tube 36. The gas has the effect of changing the density of the aluminum as seen by the lithium, thereby keeping the lithium in contact with the aluminum. Thus, preferably, sufficient gas is injected into the aluminum stream to lower its density to that or lower than the density of the molten lithium. In certain instances, the density of aluminum-gas contamination may be greater than that of lithium, depending on the flow rate of the molten aluminum through tube 36. Argon or like gas may be injected, as shown in FIG. 3 at 52.

Thus, a portion of cylinder 36 comprises a porous wall 40 surrounded by a cylindrical plenum chamber 50 into which a gas which may be termed a sparging gas is fed through inlet 52. Porous wall 50 preferably comprises a porous ceramic material which is resistant to attack by the molten metal passing through cylinder 36. However, the flow of the sparging gas has been found to provide some degree of protection to the porous ceramic, apparently by providing a protective blanket of gas over the ceramic. As examples of ceramic materials which may be used when the molten metal flowing through cylinder 36 is molten aluminum, porous wall 40 may comprise a porous ceramic such as a phosphate bonded chromia-alumina media or silicon carbide materials. The remainder of cylinder 36 may be constructed or lined with the same type of ceramic material. The porosity of wall 40 may range from about 2 to 70% The length of porous wall 40 ranges from 2 to 18 inches long.

It is also a feature of this invention that the molten metal flowing in cylinder 36 after entry of the gas stream should be, just before entry of the metal into the mixing zone to be described below, in turbulent flow with a Reynolds number of greater than 2100.

Therefore the length of porous wall 40, together with the porosity, and the gas pressure, will be selected to provide the desired volume and velocity of gas in cylinder 36 both to establish the desired molten metal density and flow conditions including velocity and Reynolds number. When the molten metal comprises, for example, molten aluminum, the volume and density of the gas must be sufficient to establish a gas void fraction of approximately 0.56, a bulk fluid density of 1.1 grams/cm$^3$, and a metal velocity of at least about 18.5 cm/sec.

The sparging gas introduced into cylinder 36 via porous wall 40 may comprise a non-reactive gas such as nitrogen or one of the rare gases, e.g., helium, neon, argon, krypton, or xenon. Alternatively, the sparging gas may comprise a reactive gas which will react with any impurities present to form a gaseous product removable with the sparging gas, e.g., a halogen gas such as chlorine which will react with a alkali metal impurity such as sodium to form NaCl.

Referring again to FIG. 3, the thoroughly mixed molten metal stream now flows, in accordance with a preferred embodiment of the invention, into an inclined passageway 80 which defines an angle of from about 90° to about 35°, preferably 60° or less and most preferably about 50°, with the common axis of cylinder 36 and feed tube 60 therein. Thus the molten metal alloy flow must turn at least about 90° and preferably at least 120° which increases the turbulence of the molten alloy flow. At this point, the bulk density of the molten mixture, for example, when a 96.5 wt. % aluminum/22 wt. % lithium alloy is formed, is 2.28 grams/cm$^3$ and the Reynolds number has been reduced from a typical 7300 for the base metal alloy just prior to mixing down to 3200. The purpose of the inclination of passageway 80 with respect to the axis of cylinder 36 is to introduce yet more turbulence into the mixed stream to maintain the homogeneous flow of the molten metal mixture.

In a preferred embodiment of the invention, a further gas diffusor zone is present in passageway 80 comprising another porous wall 86 surrounded by a plenum 90. Gas from the same source as introduced into cylinder 36 may be introduced into plenum 90 through inlet 92 at this point and the same type and size of porous materials may be used as comprise porous wall 40. This additional influx of gas at this point after the mixing zone is intended to facilitate degassing of the molten metal mixture. Since the molten metal mixture may now be passed directly into degassing zone 20 in FIG. 1, introduction of gas into the molten metal mixture in passageway 80 for degassing purposes may be optionally eliminated depending upon the physical layout of the apparatus including the distance between the mixing zone and the degassing zone.

Figure 5:
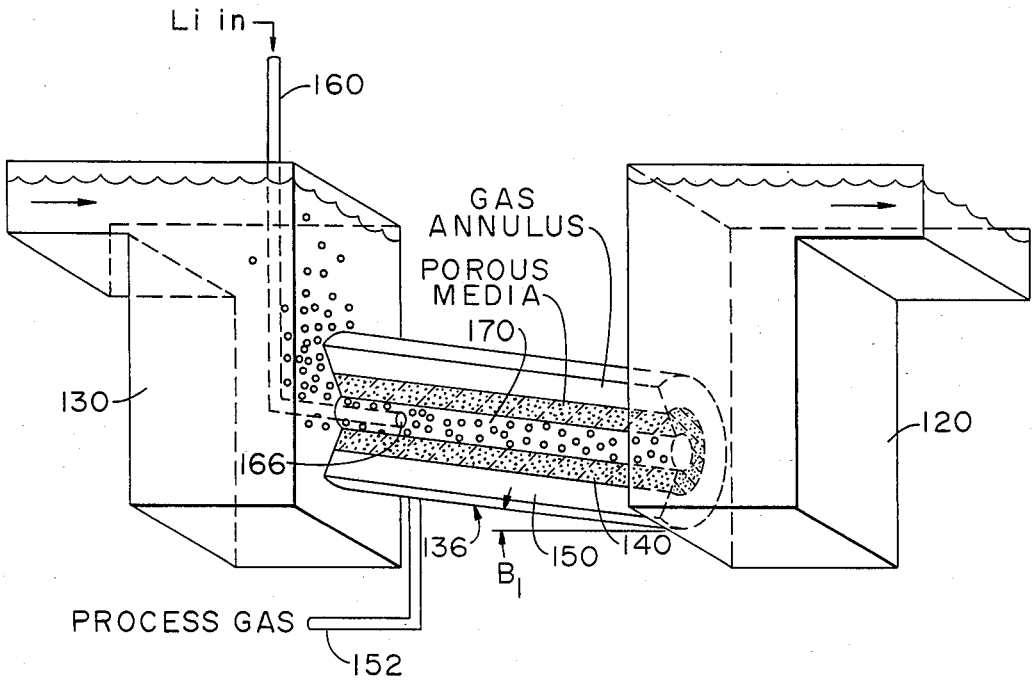
FIG. 5 is a vertical side-section view of another embodiment of apparatus useful in the practice of the invention.

Another embodiment of apparatus used in carrying out the invention is illustrated in FIG. 5. In this embodiment, the molten base alloy such as molten aluminum is heated and retained in a reservoir 130 from which it flows to a mixing zone via a cylinder 136 which, along its entire length, comprises a porous wall 140 surrounded by a plenum or annulus 150 into which a sparging gas similar to that previously described is admitted through inlet 152.

A concentrically mounted feed tube 160 concentrically feeds a molten supply of alloying metal into mixing zone 170. The end 166 of feed tube 160 terminates about one fourth to one third of the way thorough cylinder 136. By providing a porous wall along the entire length of cylinder 136, the sparging gas provides all of the benefits previously discussed along the entire length of cylinder 136.

Cylinder 136 terminates in a second chamber 120 which may comprise a degassing zone as previously discussed with regard to the embodiment of FIG. 3. It will be noted that cylinder 136 is inclined along an angle $B_1$ as it passes from reservoir 130 to reservoir 120. The purpose of this incline is to inhibit counter flow of the molten metal mixture back into reservoir 130 should the flow of molten metal through cylinder 136 be interrupted for any reason.

While the embodiment of FIG. 5 illustrates a different arrangement of the apparatus utilized in the mixing of the molten metal streams, it should be understood that the basic minimum velocity parameters and Reynolds numbers previously discussed apply equally here. In other words, the basic minimum velocity of the molten base metal should still be at least 18.5 cm/sec and the Reynolds number of the base metal flow should be at least greater than 2100 just prior to the mixing to ensure turbulent flow of the molten base metal as it enters the mixing zone.

To further illustrate the practice of the invention, a 96.5 wt. % lithium/2.2 wt. % aluminum alloy was prepared by flowing molten aluminum into a 7.5 cm diameter cylinder at a bulk fluid velocity of about 1 cm/sec. The molten aluminum had a liquid density of about 2.4 grams/cm$^3$. The molten aluminum velocity was increased to about 18.5 cm/sec by bubbling argon into the flowing metal at a rate of 0.1 cm$^3$/sec over a length of about 23 cm of the cylinder. The flow of molten aluminum at this point had a Reynolds number of about 1000. Molten lithium, flowing at a rate of about 10.2 cm/sec with a Reynolds number of about 7300, was introduced into a mixing zone within the cylinder through a 2 cm concentric feed tube. The resultant molten metal mixture had a bulk density of 2.28 grams/cm$^3$ and a Reynolds number in the mixing zone of about 3200. The molten metal alloy was passed into a degassing zone, filtered, and then poured into a mold. The metal alloy was found to be virtually free of oxides and had a hydrogen content of 0.3 ppm. Furthermore, the lithium-/aluminum content of the alloy was found to be homogeneous indicating excellent mixing of the molten metal streams in the mixing zone of the apparatus.

Thus the invention provides an improved system for the homogeneous blending together of two or more molten metal streams by introducing the alloying stream concentrically into a stream of the molten base metal flowing at a minimum velocity of over 18 cm/sec and in a turbulent flow condition signified by a minimum Reynolds number of greater than 2100. By flowing a gas through the molten base metal stream either before and/or during mixing the velocity of the stream may be increased, the density decreased, a gas void fraction of at least about 0.5 established, and the oxidation and hydrogen pickup of the alloy inhibited.

Having thus described the invention, what is claimed is:

1. A method for efficiently mixing streams of molten metal to form a molten metal alloy while inhibiting oxidation and hydrogen gas adsorption in the molten metal which comprises passing a first molten metal stream through a cylinder in a direction generally rectilinear to the axis of said cylinder and at a minimum velocity of at least 18 cm/sec into a mixing zone within said cylinder and feeding a second molten metal stream into the mixing zone through a feed tube concentrically positioned in said cylinder and having an exit port at said mixing zone around which the first molten metal stream is flowing whereby said two molten metal streams are mixed together in a mixing zone which is beneath the surface of said molten metals to minimize either oxidation or the introduction of impurities such as hydrogen into said mixture.

2. A method for efficiently mixing two streams of molten metal to form a molten metal alloy while inhibiting oxidation and hydrogen gas adsorption in the molten metal which comprises:

(a) passing a first molten metal stream through a cylinder in a direction generally rectilinear to the axis of said cylinder and at a minimum velocity of at least 18 cm/sec into a mixing zone within said cylinder; and (b) feeding a second molten metal stream into said mixing zone through a feed tube concentrically positioned in said cylinder and having an exit port at said mixing zone;

whereby prior to mixing of said molten metal streams in said mixing zone, said first molten metal stream flow in said cylinder in a direction generally parallel to the axis of said centrally positioned feed tube in said cylinder and therefore flows coaxially to the flow of said second molten metal stream within said feed tube to permit mixing of said two molten metal streams in a mixing zone which is beneath the surface of said molten metals whereby the mixing of said molten metal streams is carried out in a manner which will minimize either oxidation or the introduction of impurities such as hydrogen into said mixture.

3. The system of claim 2 wherein a gas is introduced to first molten metal stream before reaching the mixing zone.

4. The method of claim 2 wherein said second molten metal stream introduced at lower velocity through said feed tube around which said first molten metal stream flows is of lower density that said first molten metal stream whereby mixing of said molten metal streams of differing densities is further promoted by said lower velocity of said lower density molten metal introduced into said higher density first molten metal stream flow through said feed tube.

5. A method for efficiently mixing a stream of molten aluminum with a stream of a molten metal of a lighter density to form a molten metal alloy while inhibiting oxidation and hydrogen gas adsorption in the molten metal which comprises:

(a) passing a stream of molten aluminum through a cylinder in a direction generally rectilinear to the axis of said cylinder and at a minimum velocity of at least 18 cm/sec into a mixing zone within said cylinder;

(b) introducing into said stream of molten aluminum a sufficient amount of a non-oxidizing gas selected from the class consisting of nitrogen, helium, neon, argon, krypton, and xenon to reduce the density of said molten aluminum to approximately the density of said lighter density molten metal; and (c) feeding a stream of molten metal of lighter density than said molten aluminum into said mixing zone through a feed tube concentrically positioned in said cylinder and having an exit port at said mixing zone;

whereby prior to mixing of said molten streams in said mixing zone, said stream of molten aluminum flows in said cylinder in a direction generally parallel to the axis of said centrally positioned feed tube in said cylinder and therefore flows coaxially to the flow of said molten metal stream of lighter density within said feed tube to permit mixing of said two molten metal streams in a mixing zone which is beneath the surface of said molten metals whereby the mixing of said molten metal streams is carried out in a manner which will minimize either oxidation or the introduction of impurities such as hydrogen into said mixture.

6. The method of claim 5 wherein said step of flowing said molten metal of lighter density through said concentrically positioned feed tube in said cylinder further comprises flowing molten lithium into said mixing zone to form an aluminum-lithium alloy.

7. A method for efficiently mixing a stream of molten metal lithium with a stream of molten aluminum to form a molten lithium/aluminum alloy while inhibiting oxidation and hydrogen gas adsorption in the molten metal alloy which comprises:

(a) gravity feeding a stream of molten aluminum from a reservoir down through a cylinder attached thereto into a mixing zone within said cylinder at a minimum velocity at the point of entry into said mixing zone of at least 18 cm/sec;

(b) feeding a molten lithium stream at a lower velocity than the velocity of said molten aluminum stream into the center of said mixing zone through a concentric feed tube within said cylinder around which said molten aluminum stream is flowing whereby said molten lithium is introduced into said molten aluminum stream below the surface of the molten metals; and (c) bubbling a non-oxidizing gas selected from the class consisting of nitrogen, helium, neon, argon, krypton, and xenon through said molten aluminum at a rate sufficient to reduce the density of said molten aluminum in said mixing zone below that of lithium to inhibit the flow of lithium back to said aluminum reservoir;

(d) mixing said molten metal streams together in said mixing zone in the absence of oxidizing gases and hydrogen while maintaining a combined stream molten metal flow velocity in excess of 7.5 cm/sec and turbulent flow conditions signified by a Reynolds number in excess of 2100.

8. The method of claim 2 which includes maintaining turbulent flow conditions in said first stream adjacent said mixing zone sufficient to provide a Reynolds number greater than 2100.

9. The method of claim 3 wherein said first molten metal stream has a higher density than said second molten metal stream and said gas introduced into said first molten metal stream lowers said density to further promote mixing of said two molten metal streams.

10. The method of claim 9 wherein said gas is a non-oxidizing gas selected from the class consisting of nitrogen, helium, neon, argon, krypton, and xenon.

11. The method of claim 9 wherein said gas is a halogen gas.

12. The method of claim 9 wherein said step of introducing said gas into said first molten metal stream comprises feeding said gas into said stream through a porous wall.

13. The method of claim 12 wherein at least a portion of said porous wall is located upstream of said mixing zone.

14. The method of claim 13 wherein said step of introducing said gas into said first molten metal stream through said porous wall further comprises passing said gas through said porous wall at a rate of from 0.01 to 5.0 $cm^3$/sec.

15. The method of claim 3 wherein a second gas stream is bubbled into said molten metal at a point beyond said mixing zone.

16. The method of claim 2 wherein the direction of flow of said molten metal is changed at a point spaced beyond said mixing zone to create additional turbulence in the flow.

17. The method of claim 16 wherein said direction of flow of said molten metal is changed at least 90° with respect to the direction of flow of said molten metal in said mixing zone to create additional turbulence in the flow of said molten metal alloy mixture.

18. The method of claim 16 wherein said direction of flow of said molten metal is changed at least 120° with respect to the direction of flow of said molten metal in said mixing zone to create additional turbulence in the flow of said molten metal alloy mixture.

19. A method for efficiently mixing a stream of molten metal lithium with a stream of molten aluminum to form a molten lithium/aluminum alloy while inhibiting oxidation and hydrogen gas adsorption in the molten metal alloy which comprises:

(a) passing a stream of molten aluminum from a reservoir into a mixing zone at a minimum velocity at the point of entry into said mixing zone of at least 18 cm/sec;

(b) bubbling a gas through said molten aluminum at a rate sufficient to reduce the density of said molten aluminum in said mixing zone below that of lithium to inhibit the flow of lithium back to said aluminum reservoir;

(c) feeding a molten lithium stream into the center of said mixing zone through a concentric feed tube around which said molten aluminum stream is flowing; and (d) mixing said molten metal stream together in said mixing zone while maintaining a combined stream molten metal flow velocity in excess of 7.5 cm/sec and turbulent flow conditions signified by a Reynolds number in excess of 2100.

* * * * *